United States Patent [19]

Vary et al.

[11] 4,108,238

[45] Aug. 22, 1978

[54] ENERGY SAVING DEVICE FOR HABITABLE BUILDING ENCLOSURES HAVING A HEAT CHANGING SYSTEM

[75] Inventors: Robert F. Vary, 320 S. Channel, Round Lake, Ill. 60073; Anthony C. Mamo, Arlington Heights, Ill.

[73] Assignees: Robert F. Vary, Round Lake, Ill.; BVM Ltd., Arlington Heights, Ill.

[21] Appl. No.: 717,177

[22] Filed: Aug. 24, 1976

[51] Int. Cl.[2] ..... F28F 27/02; F24H 9/02; F24H 9/08; F28F 9/22

[52] U.S. Cl. ..... 165/57; 55/417; 98/116; 98/119; 165/40; 165/98; 165/103

[58] Field of Search ..... 165/57, 54, 56, 40, 165/35, 36, 98, 99, 103; 98/116, 119; 55/417

[56] References Cited

U.S. PATENT DOCUMENTS

| | | | |
|---|---|---|---|
| 1,706,280 | 3/1929 | Dyer | 98/116 |
| 1,717,327 | 6/1929 | Sponar | 165/57 |
| 1,741,930 | 12/1929 | Gnagi | 165/57 |
| 1,792,514 | 2/1931 | Spear | 98/116 |
| 1,874,043 | 8/1932 | Ilg et al. | 98/116 |
| 1,876,547 | 9/1932 | Ashley | 165/57 |
| 1,903,143 | 3/1933 | Shurtleff | 165/54 |
| 1,914,197 | 6/1933 | Davis | 165/57 |
| 1,937,811 | 12/1933 | Child | 165/57 |
| 1,937,829 | 12/1933 | Mack | 165/57 |
| 2,981,172 | 4/1961 | Kalman | 98/116 |
| 3,908,751 | 9/1975 | Sheppard, Jr. | 165/40 |

*Primary Examiner*—Charles J. Myhre
*Assistant Examiner*—Sheldon Richter

[57] ABSTRACT

A uni-directional valve arrangement placed in a predetermined location between a habitable enclosure and a heating or cooling system which is exposed to outdoor temperatures prevents air of undesirable temperature in the system from passing into the enclosure by gravity flow.

16 Claims, 6 Drawing Figures

FIG. 4
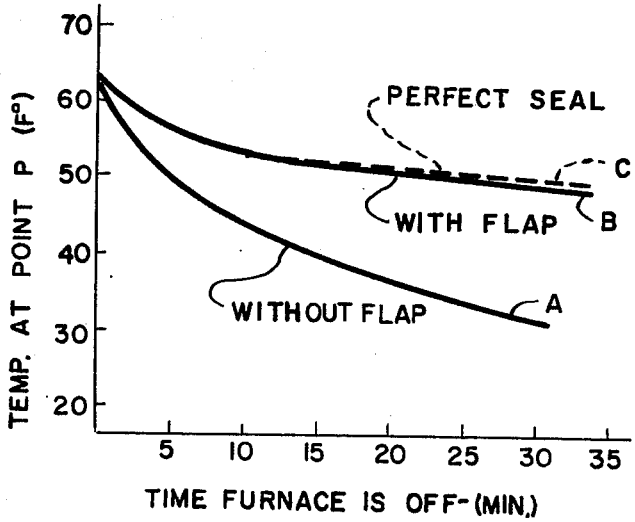
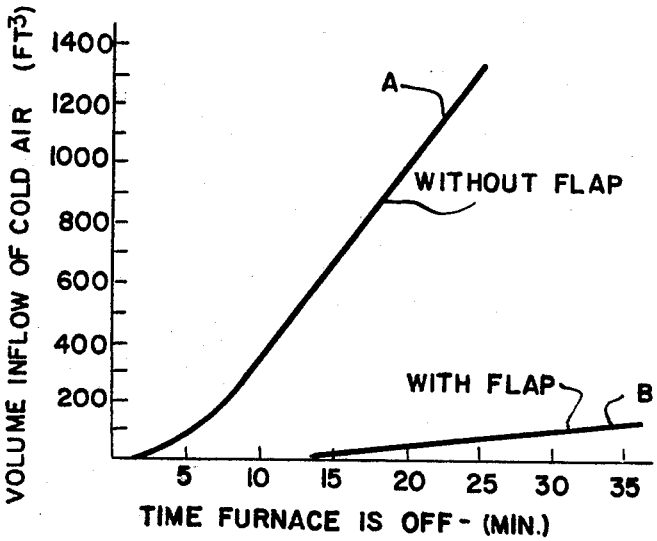
FIG. 5
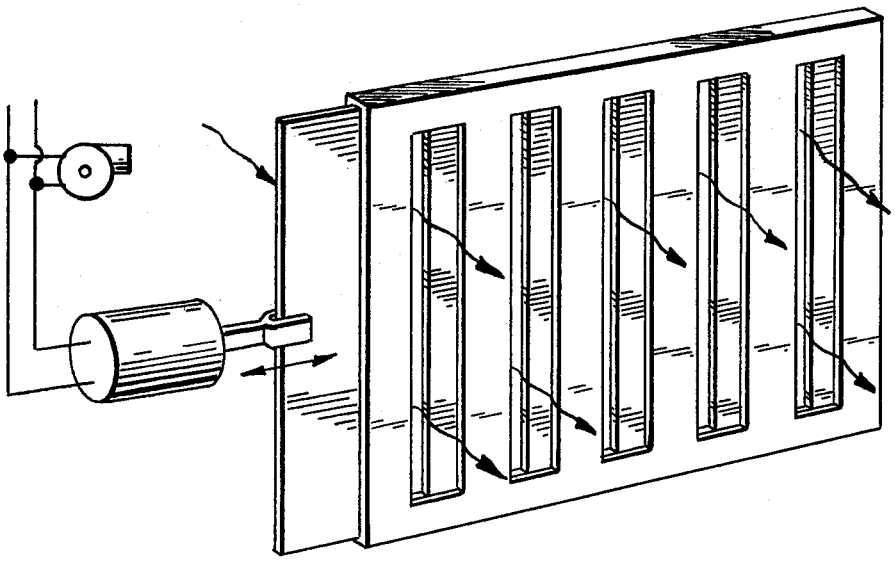
FIG. 6

ENERGY SAVING DEVICE FOR HABITABLE BUILDING ENCLOSURES HAVING A HEAT CHANGING SYSTEM

The energy saving device of the present invention is designed for use principally in connection with so-called high rise apartments or low rise apartments or office building structures where it finds use in greatly reducing the heat loss which is presently common to habitable enclosures, primarily those having a heating system disposed on an outside wall. The invention is, however, not limited to such use, and, if desired, the invention may, with or without modification, be employed in connection with other habitable enclosures, regardless of the furnace or heating plant location, or the height or other dimensions of the building, as for example those incorporated in small, low level buildings, or with mobile homes, or trailers. Irrespective of the particular use to which the invention may be put, the essential features thereof remain substantially the same.

In connection with the outside enclosures associated with high rise buildings, it has long been found expedient to provide an outside plenum chamber of box-like construction, and of a height which extends substantially from floor to ceiling level, the horizontal width and depth of such chamber being commensurate with the volume of air contained in the enclosure or room. Within such plenum chamber, there is disposed a suitable heating unit which may embody an electrical resistance heating element, or a gas or other fuel fed flame heating arrangement, or a steam or hot water heat exchange radiator, or the like, together with a fan or blower which forces air to recirculate through the chamber, either upwardly or downwardly between registers or openings near floor and ceiling levels of the enclosure or room. Due to the fact that warm air invariably rises in an enclosure due to its lesser density, in cases of cold outdoor temperatures, when the fan or blower is inoperative, the air in the plenum or chamber is rapidly cooled by the low outside temperature. This causes the cold air in the plenum chamber to move or gravitate downwardly and enter the enclosure or room at the lower region thereof, thus displacing previously heated air. At the same time, the warm air near the ceiling level of the enclosure or room is forced to enter the plenum chamber through an upper opening or register. Thereby, there is established a progressively induced gravitational circulation of air downwardly through the plenum, into the enclosure or room from the enclosure and upwardly to the upper register of the plenum chamber. As a net result there is a loss of a substantial amount of heat from the enclosure or room, and more frequent cycling of the heating system, and uncomfortably cold temperatures near the floor of the enclosure or room, and the need for a higher thermostatic setting of room temperature in order to produce a comfortable condition.

It is obvious that the longer the period of blower idleness, the greater amount of cold air will be admitted into the enclosure or room, causing a greater amount of heat loss in the enclosure or room. The heating unit in the plenum chamber is controlled by a room thermostat which causes a cycling of the heating unit operation. The more frequent the cycling and/or the longer the operation of the heating unit, the greater will be the fuel consumption and cost of heating operation.

It is known in the prior art to utilize manually operable shutters or louvers across the hot air discharge opening of the plenum chamber, such shutters being used for the purpose of adjusting the direction of the heated air, and to proportion the volume of heated air into the various enclosures or rooms. In any event, unless all the shutters are completely closed during every off cycle and re-opened during every on cycle, they have no measureable effect upon cold air reverse flow circulation through the enclosure or room and the plenum chamber as previously described. The manual closing of such shutters during every off cycle is impractical and automatically accomplishing this would be very costly and requires complex apparatus.

The present invention is designed to overcome the above-noted limitations that are attendant upon the construction and use of present day heat control systems such as has been briefly outlined above and, toward this end, the invention contemplates the provision of a system which is fully automatic in its operation and that requires no plumbing, electricity, or special attention on the part of the occupants of the enclosure or room. When a room thermostat is set, the system will function automatically to eliminate or greatly reduce the reverse circulation of cold air through the plenum chamber, thus maintaining a more even heat within the enclosure or room, and reducing the number of heat cycles of the system as well as the length of the on cycle. This arrangement, therefore, effects a substantial saving in the amount of heat energy consumed for any type of heating system using a forced circulation blower or gravity induced system, particularly when the heating system is on an outside wall.

The provision of a heat control system such as has been briefly described above, and possessing the stated advantages, constitutes the principal object of the present invention. This invention consists primarily of a uni-directional valve means disposed in a particular position with respect to the plenum chamber. The uni-directional valve means may be described as a pressure actuated one-way flapper valve arrangement. In the preferred embodiment, the total invention contemplates the provision of the usual box-like plenum chamber attached to any outside wall of an enclosure or room which is to be heated, and the positioning of the fan or blower in the heating unit, and the positioning of the one-way flapper valve, in such a manner that relatively cool air may be drawn into the plenum chamber from the enclosure or room through a cold air inlet during operation of the blower, such that cold air developed in the plenum chamber during an off cycle will be prevented from passing back into the enclosure or room by reverse circulation.

In order to prevent reverse circulation of cold air downwardly through the plenum chamber when the blower and heater are not in operation, and the volume of air in the plenum chamber has cooled to such a degree that its mass or density normally would cause the same to flow downwardly past the blower and outwardly in to the enclosure or room at or near floor level, the pressure actuated uni-directional valve means is installed within the cold air opening of the plenum chamber. Normally, the hot air discharge opening is allowed to remain unobstructed so that hot air may be forced into the closure from the plenum chamber when the blower and heating unit are in operation.

The provision of such a pressure actuated uni-direction valve in the lower opening of the plenum chamber constitutes the principal feature of novelty of the present invention, but the invention is also concerned with the use of a novel and effective form of uni-directional valve means which is extremely sensitive to small air pressure differentials on opposite sides thereof, and which will therefore operate to block the flow of air through the air inlet opening when the pressure of air on the cold plenum chamber side thereof exceeds the pressure of air on the enclosure or room side thereof even by a very slight degree.

In one embodiment of this invention, the uni-directional valving may be attached to a porous filter-like member which completely bridges the air opening to the plenum chamber, and which has associated therewith one or more free-hanging, flap-like, substantially non-porous valve elements proper. This valve element or elements are sufficiently flexible to conform to the porous filter-like member coextensively, and on the plenum chamber side of such member, so as to block reverse flow of air from the cold chamber through the lower plenum chamber opening. At such time as the pressure of air within the plenum chamber in the immediate vicinity of the uni-directional valve means falls below that in the enclosure, as for example when the blower is energized, the hanging flap-like valve element or elements proper will yield freely and present substantially no obstruction to the entrance of air into the plenum chamber, all in a manner that will be made clear when the nature of the invention is better understood.

Actually, the uni-directional valve means may be disposed either at the lower opening of the plenum chamber, or at the upper opening of the plenum chamber. The main objective is that the uni-directional valve means should present an unobstructed flow of air when the blower is in operation. Further, the uni-directional valve means should obstruct or block the loss of hot air by reverse circulation, when the blower is not in operation.

The provision of an energy saving system of the type that is contemplated is extremely simple in construction and may be manufactured at a low cost. It is one which is capable of being constructed as original equipment or which may be readily applied to the filter of existing plenum chamber type installations. It is one which is comprised of a minimum number of parts, particularly moving parts, and which therefore is unlikely to get out of order. It is one which is smooth and automatic in its operation. It is one which otherwise is well adapted to perform the services required of it. Numerous other objects and advantages of the present invention, will readily suggest themselves as the following description ensues. In the accompanying drawings, illustrative embodiments of the invention have been shown.

In these drawings:

FIG. 4 is a comparative curve in which certain temperature conditions within the enclosure or room are plotted against time, the representation being both with and without the benefit of the present invention;

FIG. 5 is a comparative graph of air flow curves which are plotted against time and which show the amount of air that is introduced into an enclosure or room as a function of time, both with and without the benefit of the present invention;

FIG. 6 is an alternate embodiment of the present invention utilizing a mechanical actuation of valve means, rather than a gravity actuated valve arrangement.

Figure 1:
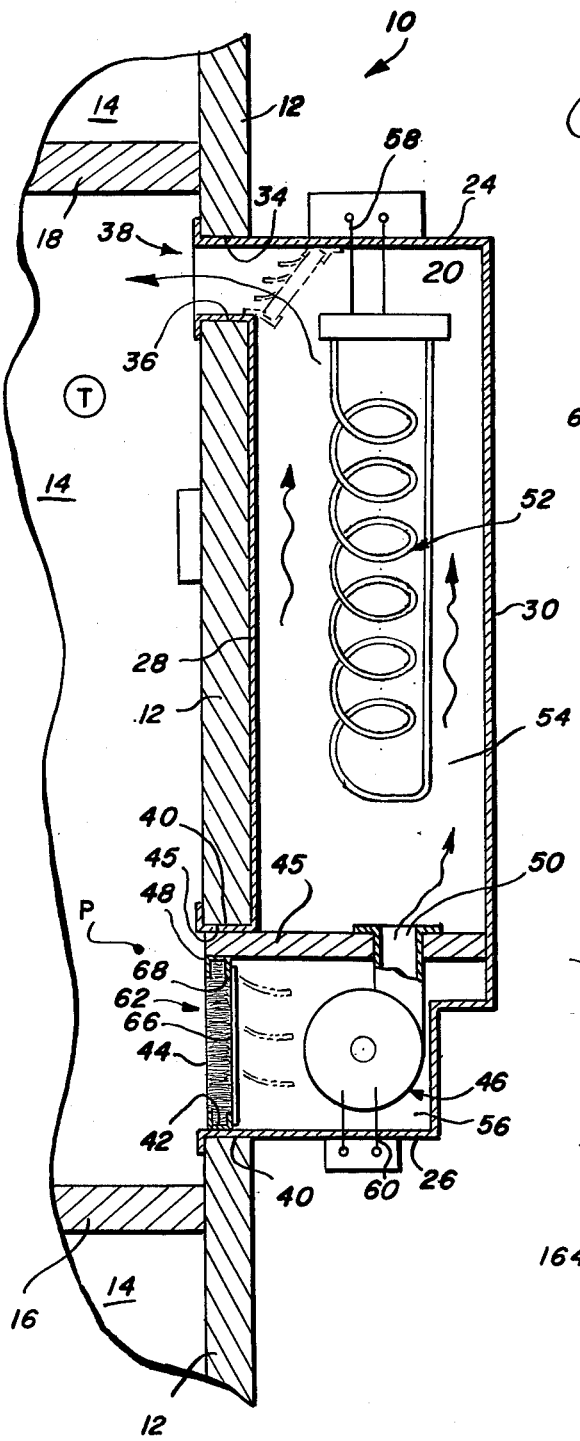
FIG. 1 is a vertical sectional view taken through a fragmentary portion of a building construction and showing the heat control system of the present invention operatively applied to an outside wall of a habitable enclosure or room associated with the building construction, the enclosure of the system being almost entirely schematic in its representation.

Referring now to the drawings in detail, and in particular to the schematic disclosure of FIG. 1, a fragmentary portion of a building construction is designated in its entirety by the reference numeral 10 and, for purposes of discussion herein, such building construction may be regarded as a low rise apartment building of the multi-level type having an outside wall of an enclosure or room 14. The system involves in its general organization an outside vertical plenum chamber 20 in the form of a box-like structure formed of conventional materials, such as sheet metal, and which includes top and bottom walls 24 and 26, respectively, an inside vertical wall 28, an outside vertical wall 30, and vertical side walls 32.

An upper inside wall extension 34 projects through opening 36 in the wall 12 near the ceiling 18 and establishes what will hereafter be referred to as a hot air discharge outlet 38 for the plenum chamber 20. Similarly, a lower inside extension wall 40 projects through an opening 42 in the wall 12 near the floor 16 and establishes what will hereafter be referred to as a cold air inlet 44 for the plenum chamber.

A partition wall 45 extends across the lower region of the chamber 20 and constitutes a horizontal shelf-like support for a fan or blower assembly 46, the latter embodying the usual air inlet opening 48 and a discharge outlet chute 50 which directs air upwardly through the plenum chamber 20. The blower assembly 46 is suspended below the level of the shelf-like support and above such support there is provided a heating unit 52, which in the illustrated embodiment of the invention, is shown as being in the form of an electrical resistance. This may, if desired, be of any other suitable type such as steam or hot water heat exchange, or a fuel fed flame with associated radiating equipment. Irrespective of the particular type of heating unit 52, the essential character of the invention remains unchanged. The horizontal wall 45 thus establishes an upper relatively large volume heating chamber 54, and a lower relatively small volume blower chamber 56.

The specific electrical circuit for the electrical resistance or heating unit 52 on the blower 46 have not been disclosed herein, since it may be varied for different installations and according to the preferences of the manufacturer of the heating system. Lead wires or connections 58 and 60 are shown as extending from members 52 and 46 respectively, and a thermostat T is shown as being appropriately positioned within the enclosure or room 14 for blower and heat control purposes, as will be described presently. It will be understood that the thermostat bears no relation to the invention insofar as novelty is concerned. It is also to be understood that no novelty is predicated upon the arrangement of parts thus far described inasmuch as the use of an outside plenum chamber similar to the chamber 20 and the mounting therein of a suitable heating unit and a blower or fan which operate under the control of the thermostat is well known. The novelty in the present invention resides in the positioning of the uni-directional valve means, such as that which has been designated in its entirety by the reference numeral 62 within the cold air inlet 44 of the plenum chamber 20 in a manner and for a purpose that will be described in additional detail.

Figure 2:
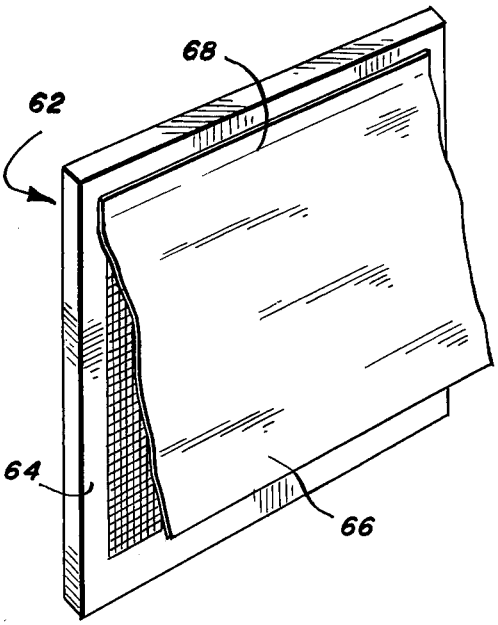
FIG. 2 is a perspective view of a uni-directional valve construction which is employed in connection with the system.

In FIG. 2, the uni-directional valve means 62 assumes the form of a frame 64 which may be rectangular, or any other shape to accommodate an air opening to the plenum chamber. The frame has associated therewith a valve element proper. Such element is in the form of a substantially imperforate or non-porous, thin, flexible sheet which may have its upper horizontal edge region adhesively or otherwise secured to the upper edge region of the frame 64 as indicated at 68. Normally, the valve element or sheet 66 hangs freely by gravity across the inside face of the backing member 64 and, since it is substantially coextensive with such member, it substantially bridges or blocks the air opening 44.

Being relatively thin and flexible, the valve element or sheet 66 is responsive to extremely small air pressure differentials on opposite sides thereof. Thus, when the pressure of air within the enclosure 14 is less than that within the plenum chamber 20, the valve element or sheet 66 (which for convenience of description herein will be referred to simply as the flap valve) will be forceably pressed against the backing member to a closed position wherein substantially no air may flow in a direction opposite to the heat cycle flow.

Conversely, when the air within the enclosure 14 is caused to circulate through the plenum chamber 20 due to blower operation, the resultant pressure difference activates that valve flaps 66 to flex inwardly toward the blower chamber 66, as shown in dotted lines in FIG. 1, thus admitting air into the plenum chamber for heating purposes and ultimate discharge through the upper air discharge 38.

The particular nature of the backing member 64 may vary widely. The only requisite being that it possesses sufficient rigidity to form a planar backing for the flap valve 66 and that it be sufficiently porous for filtering purposes to allow the necessary freedom of air passage therethrough when the flap valve is in its "open" condition as shown in dotted lines in FIG. 1. Various materials are suitable for constructing the backing member 64. Among these are styrofoam sheets, wire screening, cardboard, fiberglass, stretched and framed, loosely woven cloth such as canvas, and other forms of gridwork too numerous to mention.

Similarly, the specific nature of the flap valve 66 may vary widely. The same may be formed of tightly woven or coated cloth, various thin, flexible plastic sheets of Latex, polyethylene, Mylar, polypropylene, paper-like substances, and other sheets likewise too numerous to mention. The only base requirement being that such sheets be substantially non-porous and possess a high degree of flexibility, and also that they have sufficient mass or specific gravity to enable them to hang freely and assume a closed position when pressures of air on opposite sides thereof are substantially equal.

It has been found that one of the most effective materials for the flap valve 66 is a material of a type which acquires a strong static charge during the "on" cycle of the system. During the "off" cycle of the system, the flaps adhere to the frame and to each other to form a tight seal. Materials of this nature are latex or india rubber, or other similar compositions.

The bottom edge of the flap valve 66 may be provided with a folded edge, or the addition of a reinforcing or weight adding wire or strip to assist in gravity sealing of the flap, especially where low pressure differentials are encountered, as for example when the system is used in connection with an air conditioning system, as will be described later.

Furthermore, the bottom edge of the flap 66 may be provided with an irregular edge for the purpose of avoiding noise effects during the cycle of the system.

Figure 3:
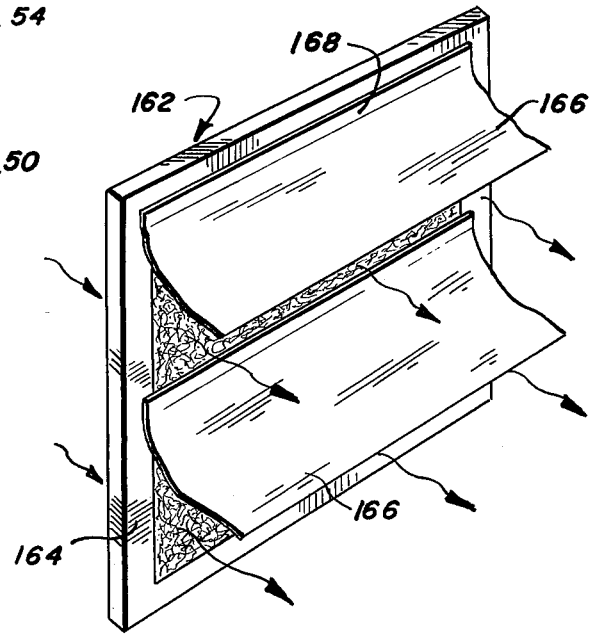
FIG. 3 is a perspective view, similar to FIG. 2, showing a modified form of uni-directional valve construction which is capable of substitution for the valve construction of FIG. 2.

FIG. 3 of the drawings shows a slightly modified form of a uni-directional valve means 162 wherein the backing plate or frame has associated therewith two or more flap valves 166. Such valves or flaps, when in their closed positions, substantially cover the inner face of the porous backing plate. The use of shorter flaps may be a necessary expedient, not from the aspect of principal of the invention, but from practical expedience, where, for instance spacing would not allow a long flap which might interfere with the blower during the on condition. There is, of course, no limit to the number of flaps that might be utilized.

The advantages of the energy saving device herein described will be readily recognized, and these have been measured and calculated through extensive testing procedures. Several examples of the numerous tests conducted will be described.

When the ambient temperature outside of the building 10 is relatively low, the cooling effect of the plenum chamber 20 is a relatively rapid one, and during such periods of time as the blower assembly 46 and the heating unit 52 are idle, a typical period of such idleness will bring the temperature of air within the chamber 20 appreciably below enclosure or room temperature. When such a situation exists, the normal tendency is for the denser air within the plenum chamber to set up a reverse circulation of air through the enclosure and chamber wherein, in the absence of the uni-directional valve means 62, the downward flow of air in the plenum chamber will force cold air into the enclosure or room 14 through the inlet opening 44. With the valve means 62 in position, this reverse cold air circulation is almost entirely prevented.

In FIG. 4 the graph shown represents a condition where outdoor temperature was 1° F. The setting on the room thermostat was 71° F. A temperature recording instrument was located within the enclosure or room, approximately 3 inches inwardly of wall 12, and at a level approximately equal to the lower horizontal edge of cold air inlet 44 which was 15 inches above the floor.

FIG. 4 shows the reading of temperature at point P as a function of time. Curve A of FIG. 4 represents the temperature without the use of the uni-directional valve means in the system. Curve B represents the drop in temperature at point P with the uni-directional valve means of the present invention in place. Curve C represents the temperature encountered at point P with the lower air inlet to the plenum chamber completely sealed or blocked, thus representing a perfect blocking or elimination of the reverse flow heat loss.

FIG. 4 shows there is a very slight difference in temperature at point P in the conditions of perfect sealing and the condition with the uni-directional valve means in place. In comparison, the condition without the uni-directional valve means in place shows a rapid drop of temperature at P. When the "on" cycles are 20 minutes apart, the temperature of incoming air at P without the uni-directional valve means in place is 37° F., while the temperature of the incoming air at P with the uni-directional valve means in place is 51° F.

FIG. 5 illustrates comparative curves showing volume of air passing through cold air inlet opening 44 as a function of time between "on" cycles of the system. The volume of air passing through the inlet opening 44 is measured in cubic feet and is determined by an extremely sensitive commercially available air flow meter. In FIG. 5, curve A represents the condition without the uni-directional valve means in place. Curve B represents the volume of air passing through opening 44 with the uni-directional valve means in place. FIG. 5 shows that after approximately 20 minutes of "off" cycle of the system, without the uni-directional valve means in place, approximately 1020 cubic feet of 37° F. air reverse flows through the opening 44 and into the enclosure or room. With the uni-directional valve means in place, after 20 minutes of "off" cycle of the heating system, only 50 cubic feet of 51° F. air pass through inlet opening 44 into the enclosure or room.

The curves of FIGS. 4 and 5 are intended to be read together, in that at a given time period of "off" condition, these curves show the temperature and volume condition of air passing point P.

A number of modifications of the present invention are considered to fall within the inventive concept.

It is appreciated that the uni-directional valve means may be used in conjunction with a conventional air filter of the type used in forced air heating and cooling systems.

With respect to effectiveness of operation, the uni-directional valve means of the type previously described can operate more effectively if the backing plate or frame is slightly inclined from vertical. This may be accomplished by any known or conventional means. Mounting in this manner will assure more effective sealing of the flaps against the frame, due to gravity than would normally be attained, when a uni-directional valve means is located in a perfectly vertical position. Conversely, care must be taken to ensure that the uni-directional valve means is not mounted in an off-vertical condition such that the flaps when hanging free are not pressed against the backing plate or frame, due to the force of gravity, so as not to allow free air passage through the valve.

The invention has been described with the uni-directional valve means located in the lower air opening 44 of the plenum chamber. This entire system can also be used effectively in connection with air conditioning systems of a similar type. In such as arrangement, the uni-directional valve means would be inserted into opening 38 of plenum chamber in such a manner as to allow cooled air to be passed from the plenum chamber through the uni-directional valve means and opening 38 into the enclosure or room when the system is in operation. When the system is not in operation, and the air in the plenum chamber is heated due to high outside temperatures, normal convection of heated air would not pass through the uni-directional valve means, because the pressure differential would not be sufficient to move the flap, and passage of unwanted heated air into the enclosure or room would be avoided. In such an installation, it would be of considerable importance to mount the uni-directional valve means at an angle off of vertical, in order to ensure that very slight flow of heated air due to convection only will not move the flaps. This construction is shown in dottend lines at the upper portion of chamber 20 in FIG. 1.

It will be appreciated that in connection with a heating system, it is irrelevant for the purposes of the present invention whether the system provides for cold air intake at the bottom vent or opening 64 and emission of heated air at the top opening 38, or vice versa, that is admission of cold air into the plenum chamber at opening 38 and discharge of heated air into the room through bottom opening 64. In connection with heating systems, or combination heating and cooling systems, effective operation will be achieved when the uni-directional valve means is located in the lowermost air inlet or in the uppermost air inlet to the plenum chamber, or in both inlets.

It is fully anticipated that the present invention can also be utilized in a system where the heating unit is not disposed on the outside wall of the building. The energy saving device will also be effective, but to a reduced degree, in connection with interior furnaces that utilize a chimney. The cold air introduced into the combustion chamber of an interior furnace can cause a cooling of the plenum chamber and a consequent cooling of the air within the plenum chamber. That air will tend to enter an enclosure or room at the lowermost point, causing undesired cooling. An insertion of the uni-directional valve means at such lowermost entry point into the enclosure or room will accomplish substantial savings of reverse flow heat energy loss.

The present invention is contemplated to also be applicable to hot air heating systems which employ no blower for air circulation, but which provide for natural gravity flow air circulation. In such installations, the insertion of the uni-directional valve means into the cold air return opening in the enclosure or room will provide effective benefits. In such an installation, the uni-directional valve means must be mounted in such a manner as to operate effectively with only slight pressure differentials, and to freely allow room air to pass out of the room, but to prevent cold air from reverse flowing into the room.

This invention further contemplates a mechanical uni-directional valve means as disclosed in FIG. 6 of the drawings. By means of this construction, a shutter or louver arrangement, mechanically operated by a solenoid motor or the like, connected to the electrical heating system, or blower, will serve the same function as the air operated flap valve system. By means of this arrangement, when the heating system is "on", the mechanical valve or shutter arrangement will be in the open position. When the heating system is "off", and the blower is not in operation, the electrical motor or solenoid will return the mechanical valve or shutter to the closed position, thereby preventing reverse flow of cold air through the opening in which the uni-directional valve means is disposed.

It is submitted that through the use of the present invention, there is achieved a greater furnace efficiency. Furnace efficiency is normally determined during the "on" or operating cycle only. The present invention shows by the curves of FIGS. 4 and 5 that the "off" condition design has a great effect on how much fuel is actually used to heat a given enclosure; and how this "off" condition heat loss can be eliminated, without necessarily effecting the specific operating efficiency of the furnace.

These tests prove that the overall efficiency (considering not heat produced from a unit of fuel, but the amount of fuel required to heat a specific enclosure) improvement would greatly reduce heating costs, extend the furnace life, reduce national fuel consumption by millions of barrels of oil per year, as well as reduce pollution through the reduction in fuel combustion by-products emitted into the atmosphere.

The addition of valve means as shown in FIGS. 2 or 6 to furnaces and/or cooling systems will improve the aforesaid overall efficiency by reducing the number of "on" cycles and reducing the duration of the "on" cycles.

The invention is not to be limited to the exact arrangement of the parts shown in the accompanying drawings or described in the specification, as various changes in the details of construction may be resorted to without departing from the spirit of the invention. Therefore, only insofar as the invention has been particularly pointed out in the accompanying claims, is the same to be limited.

What I claim is:

1. In a building construction embodying a habitable enclosure, a temperature varying system for maintaining a predetermined temperature in said enclosure, a housing for said temperature varying system which housing is exposed to outdoor temperature influences, an upper register constituting an opening for passage of air between the upper portions of said habitable enclosure and said housing, and a lower register constituting an opening for passage of air between the lower portions of said habitable enclosure and said housing, the improvement consisting of a uni-directional non-rigid flap valve means interposed in at least one of said registers to allow passage of air in one direction when the air in said enclosure is being desirably temperature adjusted by said temperature varying system, and to prevent passage of air in the opposite direction when the air in said enclosure is being undesirably temperature adjusted due to outdoor temperature influence.

2. The improvement as claimed in claim 1, wherein said housing is disposed on an outside wall where it is readily subject to outdoor temperature influences.

3. The improvement as claimed in claim 1, wherein said temperature varying system consists of a heater, and a cooling system and a blower for moving air through said housing over said temperature varying system.

4. The improvement as claimed in claim 1, wherein said temperature varying system consists of a cooling system for air passing through said housing, and a blower for moving air through said housing over said cooling system.

5. The improvement as claimed in claim 4, wherein said uni-directional valve means is disposed in said upper register to block passage of warm air from said housing into said enclosure during the off cycle of said cooling system.

6. The improvement as claimed in claim 1, wherein said uni-directional non-rigid flap valve means comprises a backing member which allows free passage of air and is of configuration to cover the register in which it is disposed, and one or more substantially imperforate flexible flaps proper hingedly connected at their upper edges to said backing member and movable between closed position wherein the flap overlies the backing member coextensively, and an open position where the unsecured portion of the flap is moved away from the backing member.

7. The improvement as claimed in claim 6, wherein said flaps are relatively light in weight to allow ready displacement to open position with minimal resistance in response to passage of current of moving air, and to allow free hanging to a closed position under influence of gravity in absence of current of moving air in proper direction.

8. The improvement as claimed in claim 6, wherein said flaps are formed of a material having the characteristic of becoming adhesively attracted as by an electrostatic charge, to said backing member and adjacent flaps.

9. The improvement as claimed in claim 6, wherein said backing member comprises an air filter medium.

10. The improvement as claimed in claim 6, comprising means applied to the bottom edge of said flaps to produce a greater response to gravity for improved sealing in closed position.

11. The improvement as claimed in claim 6, wherein said uni-directional valve means is disposed in a position slightly off of vertical to allow for greater sealing effect due to effect of gravity on said valve flaps when in position against said backing member during off cycle of said temperature varying system.

12. The improvement as claimed in claim 1, wherein said temperature varying system consists of a heater for passing air through said housing.

13. The improvement as claimed in claim 12, wherein said uni-directional valve means is disposed in said lower register to block passage of cold air from said housing into said enclosure during the off cycle of said heater.

14. The improvement as claimed in claim 12, wherein said uni-directional valve means in both of said upper and lower registers to block passage of reverse flow air from said housing into said enclosure.

15. The improvement as claimed in claim 12, wherein said temperature varying system consists of a blower for moving air through said housing over said heater.

16. The improvement as claimed in claim 15, wherein said heater is of a flame type disposed centrally of the building construction, and comprising a chimney for removal of exhaust gases to the outdoors, and which chimney provides the heat exchange influence of cold air upon enclosure air circulated through said housing.

* * * * *

UNITED STATES PATENT AND TRADEMARK OFFICE

CERTIFICATE OF CORRECTION

PATENT NO. : 4,108,238

DATED : August 22, 1978

INVENTOR(S) : Robert F. Vary

It is certified that error appears in the above-identified patent and that said Letters Patent are hereby corrected as shown below:

On the cover page Item (73)

The name "Robert F. Vary, Round Lake, Ill." should be deleted as an assignee.

Signed and Sealed this

Sixth Day of March 1979

[SEAL]

*Attest:*

RUTH C. MASON
*Attesting Officer*

DONALD W. BANNER
*Commissioner of Patents and Trademarks*